United States Patent [19]

Weaver et al.

[11] Patent Number: 4,492,104

[45] Date of Patent: Jan. 8, 1985

[54] EXPLOSIVE SHAPING OF METAL TUBING

[75] Inventors: Henry Weaver; Joseph C. Pawlush, both of York, Pa.

[73] Assignee: Meadowcraft Inc., Birmingham, Ala.

[21] Appl. No.: 326,451

[22] Filed: Dec. 2, 1981

[51] Int. Cl.[3] ..... B21D 26/02

[52] U.S. Cl. ..... 72/56; 29/421 E

[58] Field of Search ..... 72/56; 29/421 E

[56] References Cited

U.S. PATENT DOCUMENTS 3,566,646 3/1971 Walkup ..... 72/56

3,797,294 3/1974 Roth ..... 72/56

*Primary Examiner*—Leon Gilden

*Attorney, Agent, or Firm*—Grimes & Battersby

[57] ABSTRACT

A method and an apparatus for the explosive shaping of metal tubing are provided. A die including a pair of die halves are opened and closed by means of a clamping assembly attached thereto. The die halves include a plurality of die segments which are coupled in series. A breech is secured to one end of the die. A shotgun shell may be loaded into the breech and fired by means of a detonator. The necessary force for deforming the tubing is accordingly provided. A water retaining block is secured to the end of the die opposite the breech so that water can be held in the tubing prior to detonation of the shell.

1 Claim, 8 Drawing Figures

EXPLOSIVE SHAPING OF METAL TUBING

BACKGROUND OF THE INVENTION

The field of the invention relates to the explosive shaping of metal tubing.

The shaping of metal tubing has commonly been accomplished by means of a spinning apparatus. The tubing is rotated about its longitudinal axis at high rpm while a spinning roller tool contacts its outer surface. If aluminum tubing is to be shaped by this process, relatively costly material is required as there must be "0" temper in aluminum. The process is essentially limited to circular deformations.

Explosive shaping of metal structures including tubing has been known for some time. U.S. Pat. No. 3,136,049 discloses a method wherein a cylinder blank is placed into a split die having a desired configuration. A string explosive charge is centered within the blank which is then filled with a fluid such as water. Upon detonation of the explosive, the shock waves are transmitted by the fluid forcing the cylinder blank to conform to the configuration of the die. FIGS. 3 and 4 of the patent are illustrative of the process.

U.S. Pat. Nos. 3,206,845, 3,235,955, and 3,252,312 are representative of the art of explosive shaping as it stands today.

SUMMARY OF THE INVENTION

This invention provides a method and apparatus for the explosive shaping of metal tubing. The apparatus is designed to permit the shaping of various size tubing into any desired form.

A female forming die or mold is constructed and separated in halves parallel to the length of the die. The interior of the die is a negative of the configuration desired on the exterior surface of the tubing. To facilitate construction of the die, it can be made up of a plurality of segments having male and female interlocking flanged ends. A fluid retaining segment is provided at one end of the die and a breech block and bolt assembly is provided at the opposite end thereof. The die halves are bolted into a clamping press that allows the die to be separated for loading and unloading.

A length of tubing is inserted into the die, the clamping press is closed, and locking means are actuated for locking the press. A shell is loaded into the breech and the bolt thereof is locked. The tubing is filled with a shock-transmitting fluid such as water. The shell is then discharged causing an explosive charge to be transmitted to the interior wall of the tubing. The exterior surface thereof accordingly assumes the shape of the interior wall of the die. The clamp is then opened and the tubing removed.

DETAILED DESCRIPTION OF THE INVENTION

Figure 1:
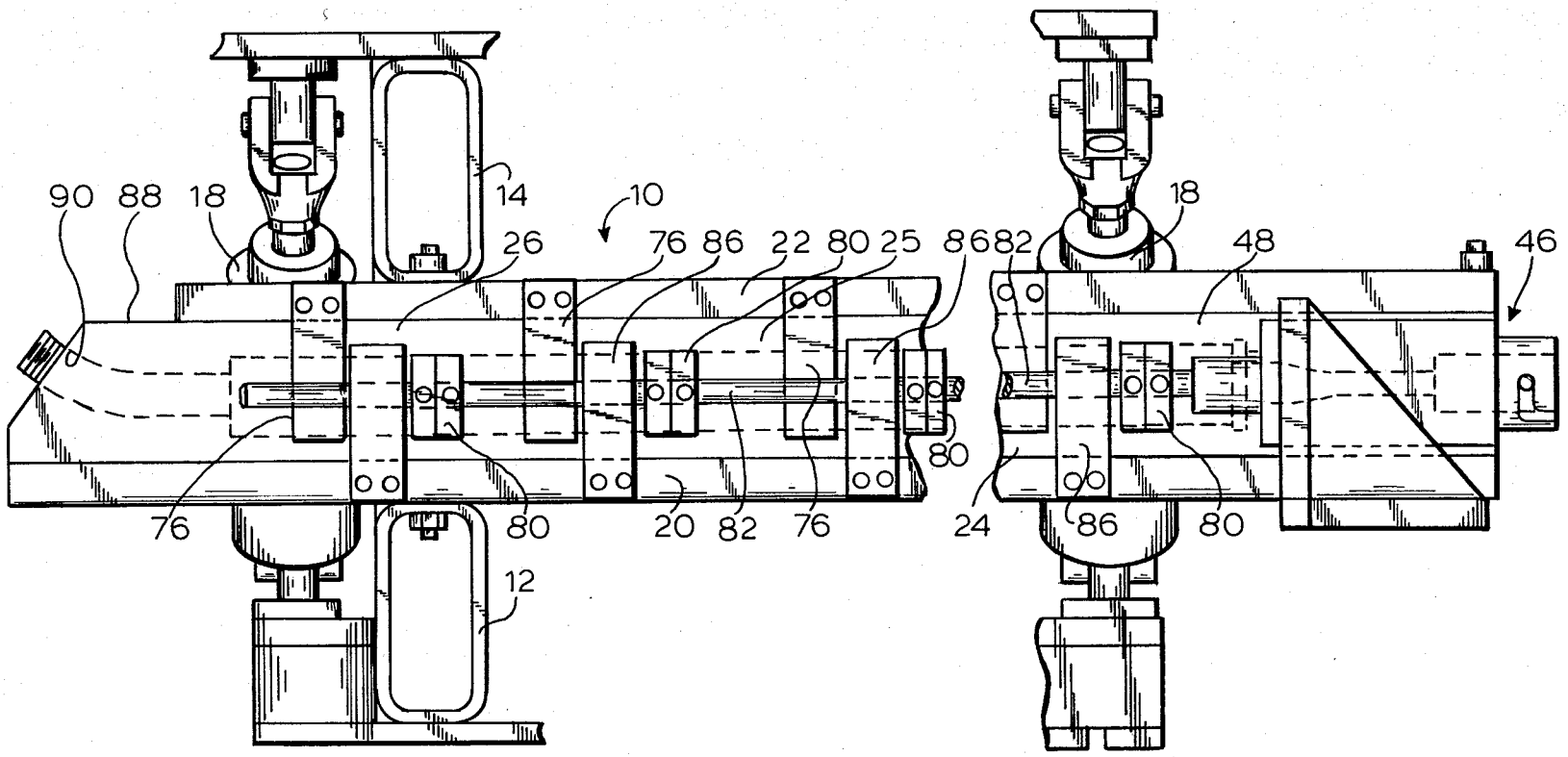
FIGS. 1 and 1A are side elevation views illustrating an apparatus for the explosive shaping of metal tubing.
Figure 1A:
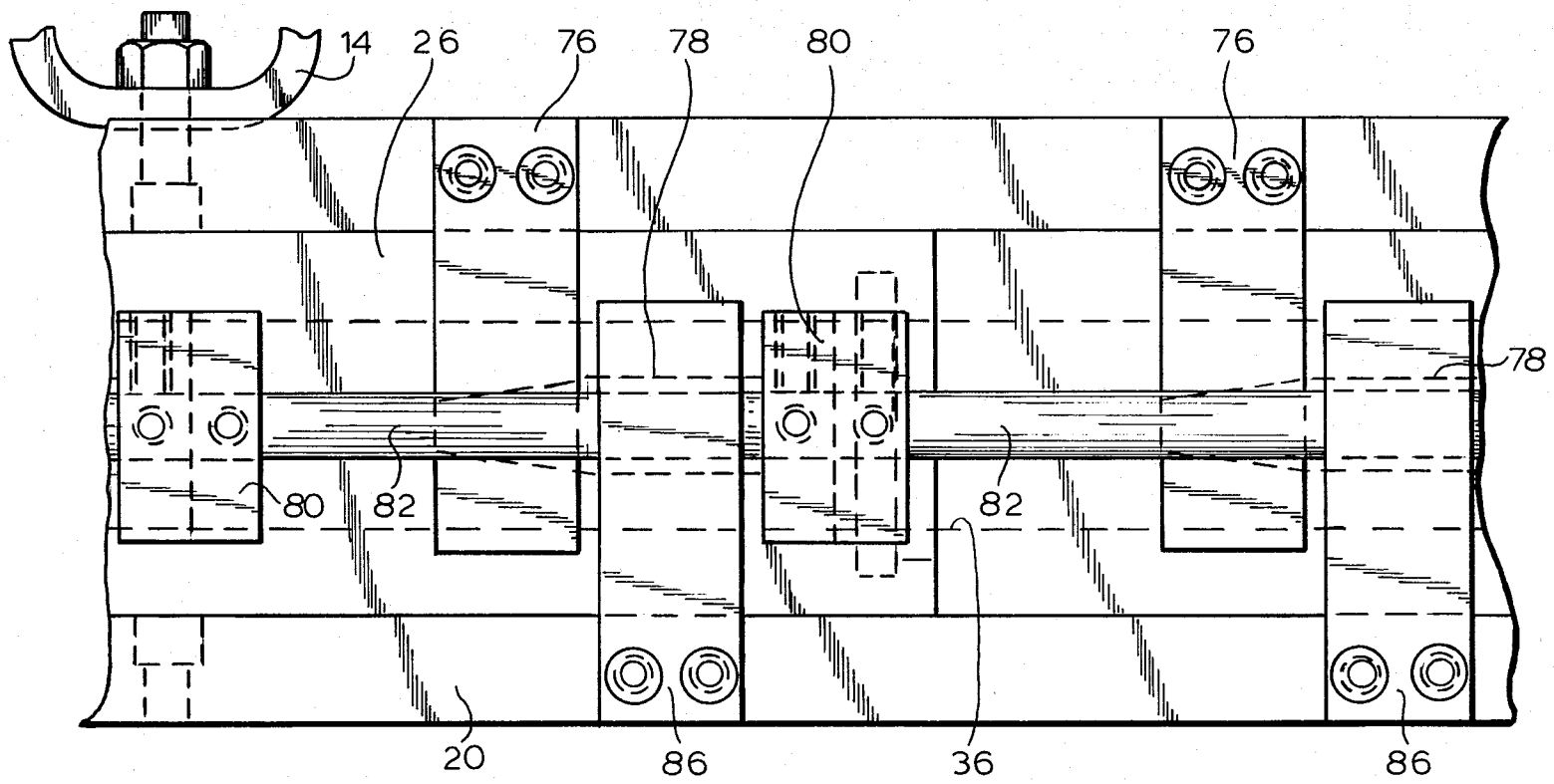
Figure 2:
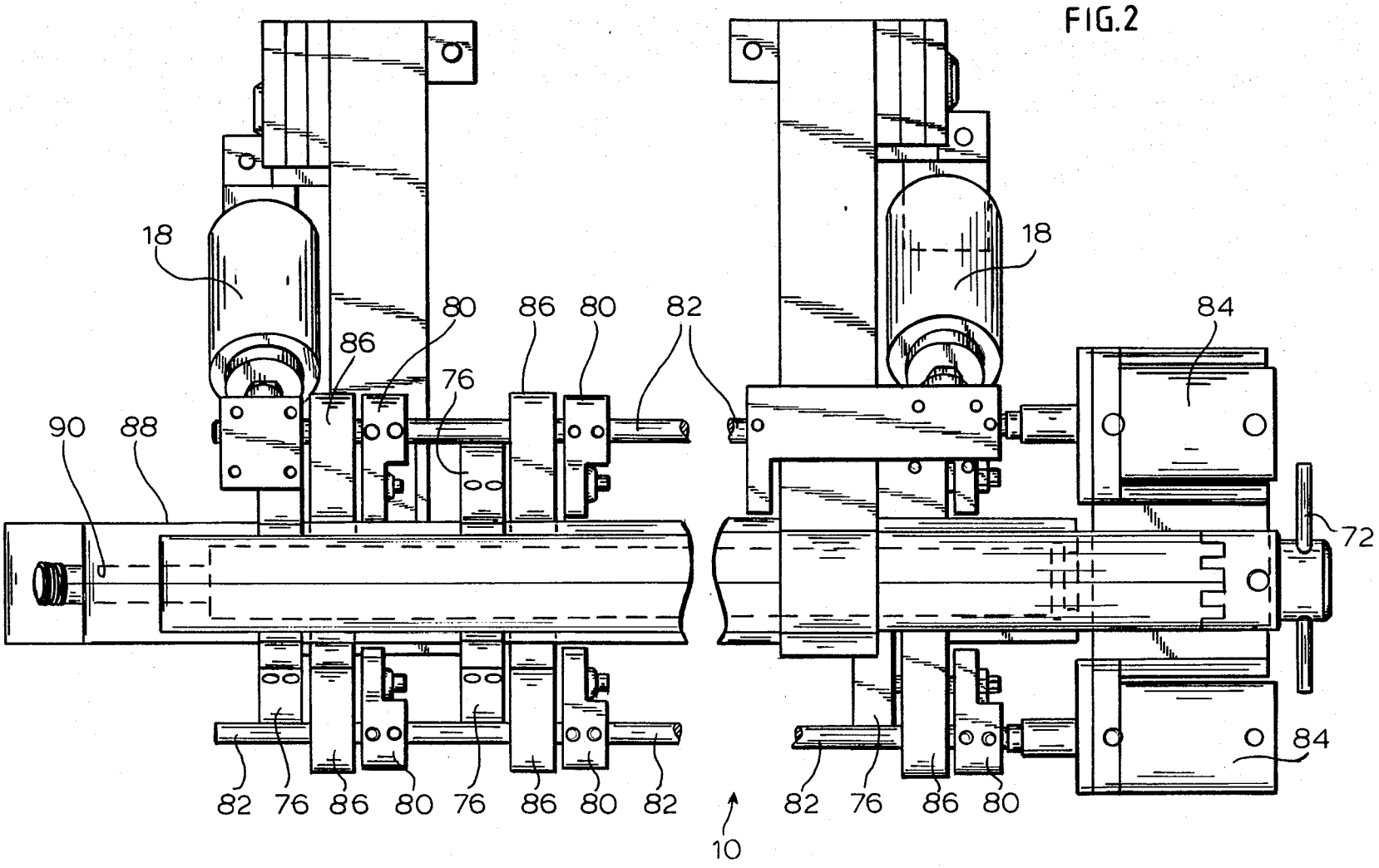
FIGS. 2 and 2A are plan views, respectively, of the apparatus shown in FIGS. 1 and 1A.
Figure 2A:
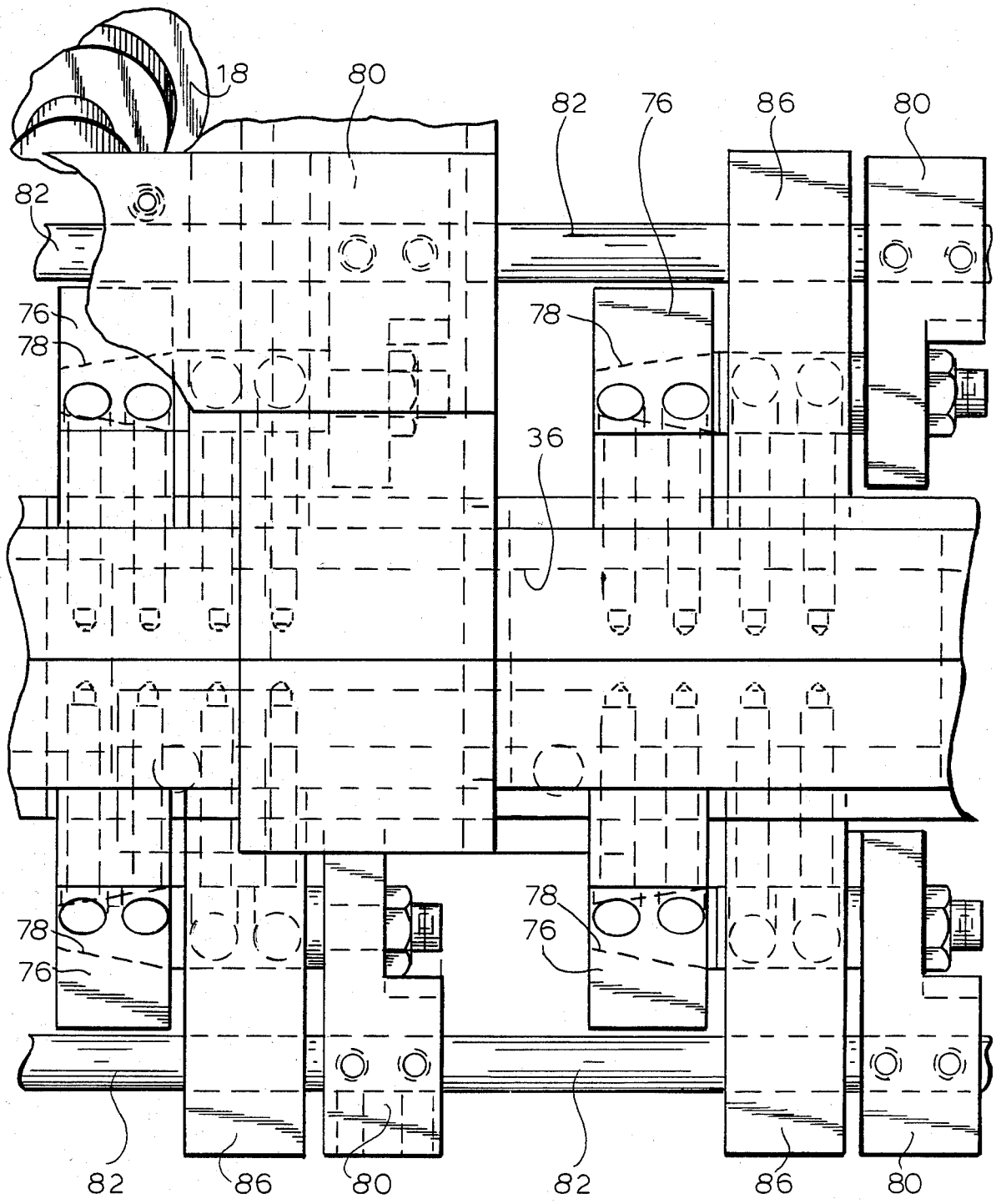

An apparatus is disclosed for the explosive shaping of metal tubing or any other tubing having the necessary properties for allowing this type of restructuring. The apparatus is composed of a plurality of segments of substantially identical construction. FIGS. 1, 1A, 2, and 2A illustrate several such segments. FIGS. 1 and 2 provide views of the end portion of the apparatus while 1A and 2A show certain parts of the apparatus in greater detail. The segments between the Figures are not shown as they are substantially identical to those illustrated herein.

Figure 3:
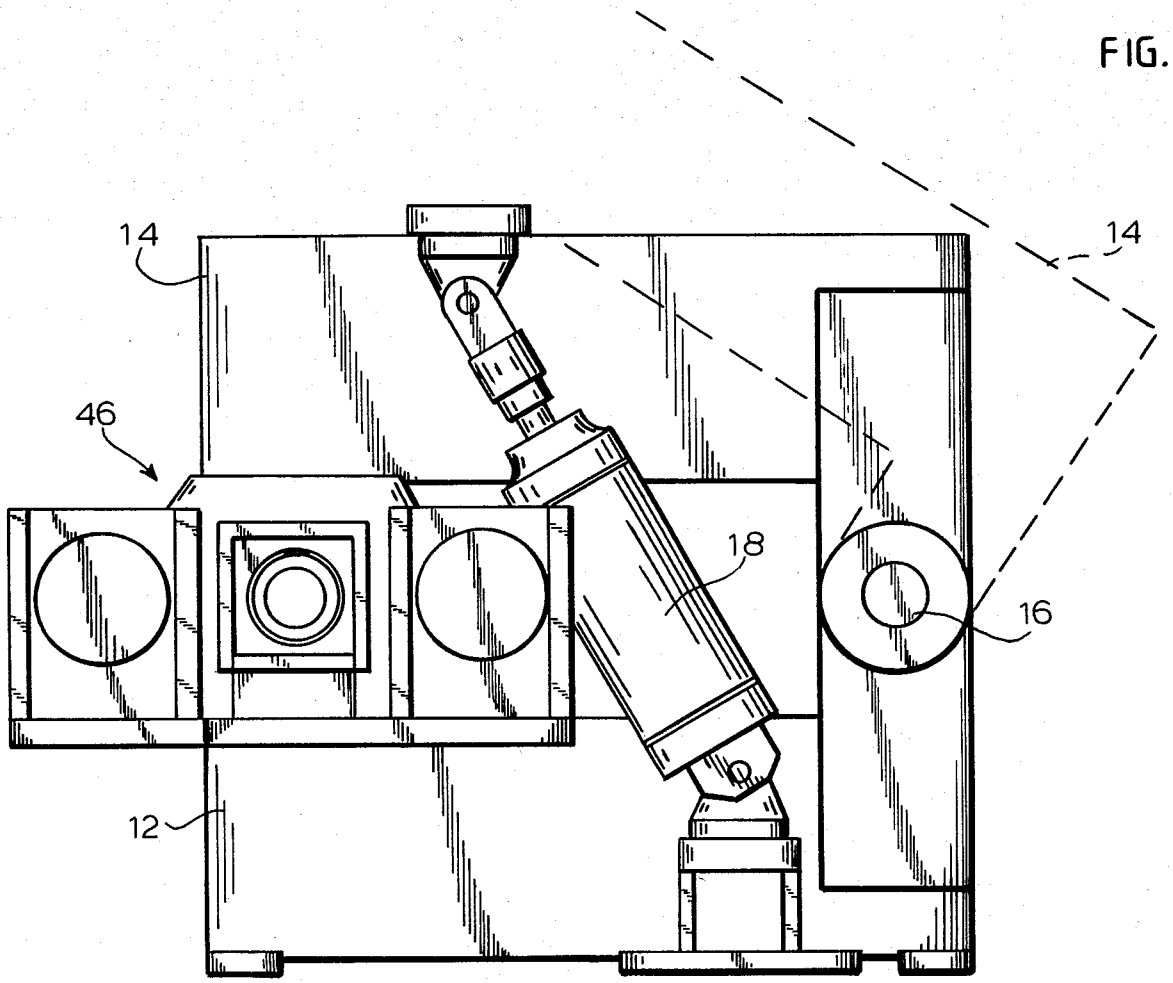
FIG. 3 is an end view of the apparatus shown in FIGS. 1A and 1B illustrating a portion of a breech assembly.

A clamping press 10 including a plurality of pairs of clamp frames is most clearly shown in FIGS. 1 and 3. Each frame includes a bottom frame assembly 12, a top frame assembly 14, and a hinge 16 connecting the two assemblies. An air cylinder 18 is pivotally connected between the assemblies 14, 16 for opening or closing one with respect to the other. The open position of one of the clamp frames is shown in phantom in FIG. 3. It will be appreciated that as the piston within the air cylinder 18 projects outwardly with respect thereto, the top frame assembly 14 will move in an arc about the axis of the hinge 16 causing the frame to assume an open position. A plurality of clamp frames are provided along the length of the apparatus to insure that the clamping press 10 opens evenly. Means (not shown) are provided for actuating the air cylinders 18 of all of the frames simultaneously.

Figure 4:
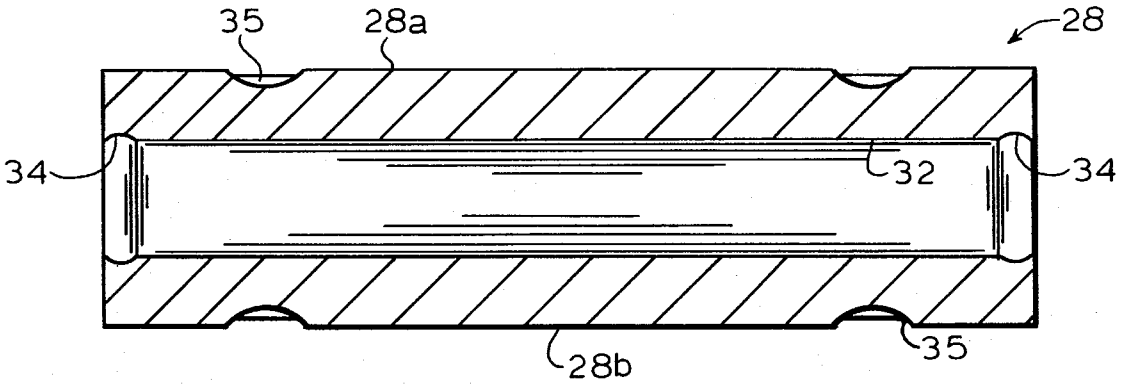
FIG. 4 is an elevation view of a die segment.
Figure 5:
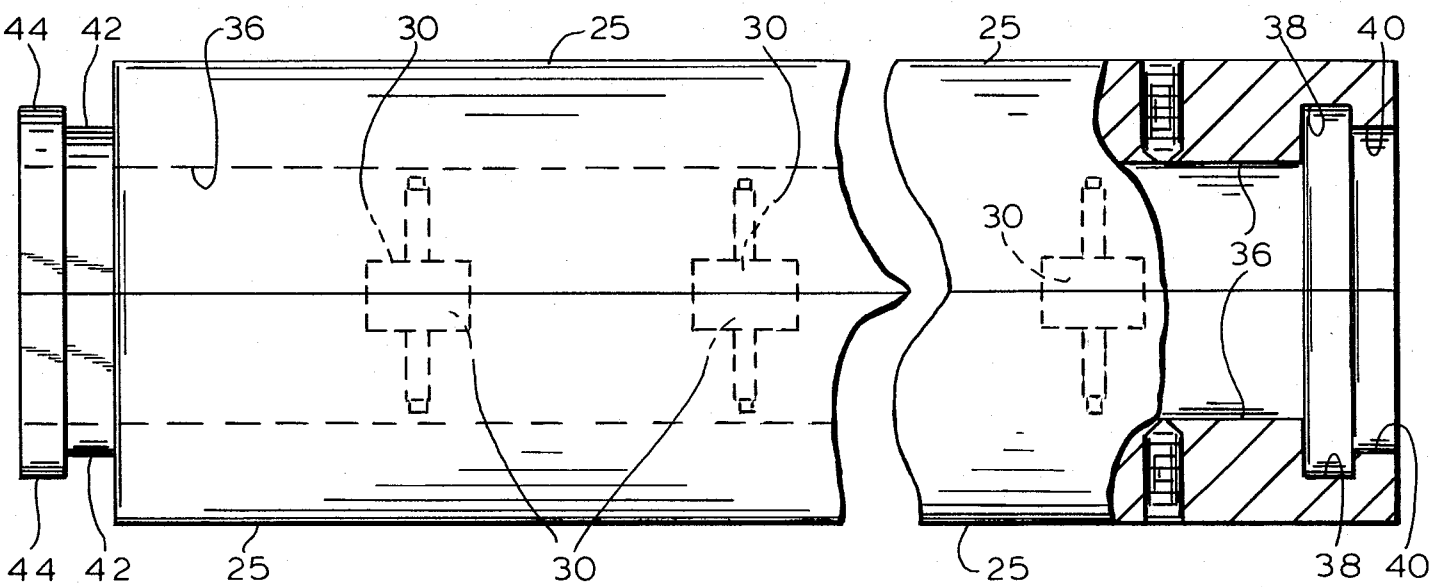
FIG. 5 is a side elevation view of a die containment block.

The bottom frame assembly 12 is bolted to a bottom support bar 20 of the apparatus while the top frame assembly is bolted to a top support bar 22 thereof. Die containment blocks 24, 25, 26 are fastened to the support bars 20, 22. The forming dies 28, which are used to shape the substrate tubing upon actuation of the apparatus, are held within the containment blocks by the use of clamp keys 30 as shown in FIG. 5. FIG. 4 illustrates a forming die segment 28 including two identical semicylindrical halves **28*a*, 28*b*. A substantially cylindrical bore 32 having an enlarged annular end portion 34 extends axially through the die segment. The configuration of the bore will cause the substrate metal tubing to assume the shape of a length of bamboo. Other configurations may be employed to obtain different shapes. The exterior of the die segment is substantially cylindrical with the exception of a pair of notches 35 near each end for receiving the clamp keys 30**.

One of a plurality of center die containment blocks 25 is illustrated in FIG. 4. A breech block end containment block 24 and a choke end containment block 26 are also provided within the apparatus.

The center block 25 shown includes two adjoining halves which form a structure having a square cross-sectional configuration. A longitudinal bore 36 extends through the block and is of sufficient size to accomodate a die. The bore is substantially cylindrical with the exception of a pair of adjoining enlarged annular portions 38, 40 at one end thereof. The larger 38 of the two annular portions is located towards the interior of the block with respect to the portion 40 of smaller diameter.

The opposite end of the block 25 includes a projection including a pair of rings 42, 44. The smaller ring 42 adjoins the end face of the block while the larger ring 44 adjoins the smaller. The diameters of the rings correspond, respectively, to the diameters of the annular portions 38, 40. Sufficient clearance is provided to allow the rings of one block to fit within the annular portions of an adjoining block.

Figure 6:
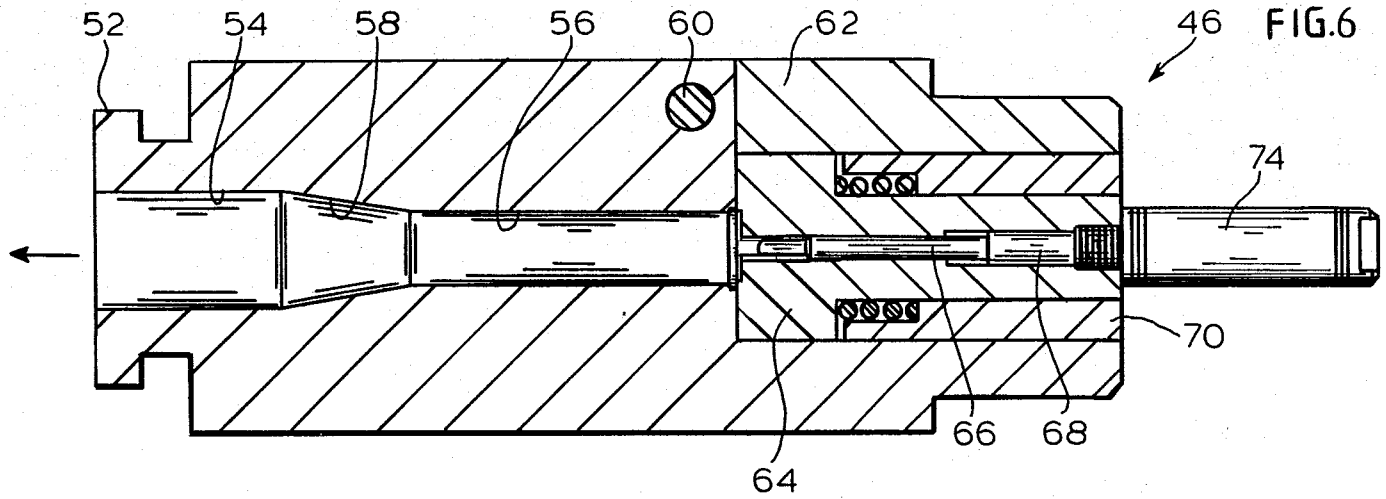
FIG. 6 is a sectional view of a breech block assembly.

A breech block assembly 46 used in conjunction with the invention is shown in FIG. 6. This assembly is secured to a breech adapter block 48 which is in turn secured to the breech end containment block 24. The means for attaching these components are similar to those described above for attaching the respective center blocks 25.

The breech block assembly includes a block subassembly 50 having a male end portion 52. A relatively large cylindrical bore 54 extends partially within the block subassembly 50 from the male end portion. The large bore 54 is connected with a smaller bore 56 which extends the remaining length of the subassembly. A conical bore portion 58 connects the smaller and larger bores.

The breech block assembly further includes a hinge pin 60, a receiver cover 62, an interior bolt 64, a detonating pin 66, a coupling 68, a bolt body 70, a locking pin 72, and an air cylinder 74. The detonator pin is air actuated.

A plurality of top latch brackets 76 are fastened to the top lateral die support bar 22 nesting over the containment blocks 24, 25, 26. The brackets 76 are bored to receive the tapered ends of latch pins 78 when actuated. Latch pin blocks 80 are bored and tapped to receive the threaded ends of the latch pins 78 and also bored to support clamp actuating bars 82. The clamp actuating bars 82 are activated by a pair of air cylinders 84.

Bottom latch brackets 86 are fastened to the bottom lateral die support bar 20 nesting under the containment blocks 24, 25, 26. They are bored to receive the straight sections of the latch pins 78 as well as the clamp actuating bars 82. The frame portion is omitted from the choke end containment block section of FIG. 2 of the apparatus to reveal a top latch bracket 76, a latch pin block 80, and a bottom latch bracket 86.

A choke block 88 is secured to the choke end containment block 26 at the end of the apparatus opposite the breech. Pressurized water may be exhausted through this block, but it is otherwise designed for retaining water within the apparatus. A conduit 90 having an upward bend extends through the block to allow the retention of water.

The choke block is machined to receive a stop spacer and choke washer. The stop spacer is interchangeable for different size tubing. The choke washer is also interchangeable with washers having various size apertures in order to obtain deformation of the tube at the end of the die.

The operation of the apparatus for the explosive shaping of metal tubing shall now be described. A length of tubing is loaded into the open die. As described above, the die includes a plurality of die segments. It will be in the open position when the clamping press 10 is in the position shown in phantom in FIG. 3. The clamp bar cylinders 18 are then actuated to close the press. To lock the die halves, the clamp actuating bars 82 are activated by means of air cylinders 84. The latch pin blocks 80, which are located along the clamp actuating bars equidistantly from each other, engage the latch pins 78 through the bottom latch bracket 86 into the tapered hole in the top latch bracket 76.

A blank shotgun shell of appropriate gauge is loaded into the receiver of the breech block assembly 46, and the bolt therein is engaged and locked. A twelve gauge shell has been employed in conjunction with the apparatus disclosed. The charge would vary for different size tubing. For example, a 20 grain charge used on $1\frac{1}{4}$-inch diameter by 16 gauge wall 5052 T4 aluminum tubing was sufficient to provide acceptable definition.

The substrate tube is filled with water through the choke block. The shell may then be fired to cause the exterior of the tube to assume the shape of the interior surface of the die. By again activating the bar cylinders 84, the activating bars 82 move in the direction opposite to that described above. The clamp press may then be opened by means of air cylinders 18 and the tube removed. All remaining water is removed with an air blast originating in the breech assembly. The spent shell is finally removed.

By using water as a medium within the tube, nearly one hundred percent of the force exerted by the explosive charge is transmitted to the interior wall of the tube. This decreases the size of the charge required for proper deformation. The water also acts as a buffer to eliminate carbon deposits within the tube from the explosive charge.

It will be appreciated that the shaping apparatus according to the invention may include any desired number of die segments and containment blocks. For example, the embodiment described above includes one end die segment and thirteen intermediate die segments. Each of the intermediate segments is about ten inches in length. Six center containment blocks 25 are engaged between breech block end containment block 24 and the choke end containment block 26. The center blocks 25 are each about twenty inches in length excluding the protruding flanges. Sixteen latch pin blocks 80 are located on approximately ten inch centers on each of the clamp actuating bars 82. A total of six pairs of clamp frames comprise the clamping press 10.

The apparatus according to the invention is easily assembled and disassembled thereby providing advantages over the prior art constructions referred to above.

What is claimed is:

1. A method for explosively shaping a deformable metal tube blank comprising the steps of:

providing a forming die having a bore therein, the surfaces defining said bore being a negative of the configuration desired on the exterior surface of the metal tubing to be shaped;

providing a breech assembly at one end of said bore, said breech assembly including means for receiving a shell, detonating means for exploding said shell, and means for connecting said breech assembly with said bore such that the exploding of said shell causes an explosive force to be exerted within said bore; filling said metal tube blank with a liquid medium;

exploding said shell thereby causing said liquid medium to transmit the explosive charge to the inner wall of the tube and cause the tube blank to assume the desired configuration; and removing the liquid medium from said tube by causing a blast of gas from said breach assembly to be introduced into said tube.

* * * * *